United States Patent [19]

Plumley

[11] Patent Number: 4,887,868

[45] Date of Patent: Dec. 19, 1989

[54] DUAL AUGER CONTINUOUS MINING MACHINE

[75] Inventor: Roger D. Plumley, Crab Orchard, W. Va.

[73] Assignee: Fairchild International Inc., Glen Lyn, Va.

[21] Appl. No.: 279,940

[22] Filed: Dec. 5, 1988

[51] Int. Cl.[4] ..... E21C 1/00; E21C 27/20; E21C 29/22; E21C 35/20

[52] U.S. Cl. ..... 299/57; 299/76; 299/71

[58] Field of Search ..... 299/57, 55, 56, 76, 299/71, 90, 18

[56] References Cited

U.S. PATENT DOCUMENTS

| | | | |
|---|---|---|---|
| 2,864,600 | 12/1958 | Kirkpatrick | 299/55 X |
| 3,026,098 | 3/1962 | Wilcox | 299/42 |
| 3,269,776 | 8/1966 | Munger | 299/57 |
| 3,304,123 | 2/1967 | Coffman | 299/57 X |
| 3,305,271 | 2/1967 | Galis et al. | 299/57 |
| 3,858,940 | 1/1975 | Lagowski | 299/18 |
| 3,897,976 | 8/1975 | Gallis | 299/18 X |
| 4,256,343 | 3/1981 | Black et al. | 299/31 |
| 4,341,424 | 7/1982 | Wilcox, Jr. et al. | 299/57 |

*Primary Examiner*—Stephen J. Novosad
*Attorney, Agent, or Firm*—Cushman, Darby & Cushman

[57] ABSTRACT

A continuous mining machine comprising a forward cutter assembly connected for horizontal pivotal movements with respect to a rearward assembly mounted on the endless track assembly. The cutter assembly includes a central frame and a pair of said frames mounted on the central frame for independent pivotal movement about a pair of axes generally parallel with each other extending in a longitudinal direction corresponding generally to the forward direction of movement of the forward assembly with respect to the mine face. An elongated shaft is rotatalby mounted on each of the side frames so as to extend longitudinally from a position adjacent the rearward portion of the associated side frame forwardly thereof to an extent such that a forward end portion of each shaft extends forwardly of the associated side frame. A speed reducing units is mounted on each side frame between the associated shaft and the associated pivotal axis in driving relation with respect to the rearward portion of the associated shaft. An electric motor is mounted on each side frame between the associated shaft and the associated pivotal axis forwardly of the associated speed reducing unit in driving relation thereto. The hydraulic ram units which effect the swinging movement of the cutter assembly are detachably mounted so as to enable the same to be operated in such a way that contracting and extending movements are utilized to effect removal and installation of the motor and speed reducing unit on the corresponding side frame rather than pivotal movements of the cutter assembly.

15 Claims, 8 Drawing Sheets

DUAL AUGER CONTINUOUS MINING MACHINE

This invention relates to continuous mining machines and more particularly to continuous mining machines of the type utilizing twin auger cutters as the means for removing the mine material from the mine seam.

The type of mining machine herein contemplated is specifically disclosed in U.S. Pat. No. 4,341,424, the disclosure of which is hereby incorporated by reference into the present specification for background purposes. The invention also has applicability to dual auger continuous miners of different construction such as embodied in the following U.S. Pat. Nos. 3,026,098, 3,269,776, 3,858,940 and 4,256,343.

All of the mining machines disclosed in the above-identified patents include a cutter assembly which is suitable to be moved forwardly with respect to a mine face and transversely across the mine face. The cutter assembly includes a central frame and a pair of side frames mounted on the central frame for independent pivotal movement about a pair of axes generally parallel with each other extending in a longitudinal direction corresponding generally to the forward direction of movement of the forward assembly with respect to the mine face. An elongated shaft is rotatably mounted on each of the side frames in generally parallel relation to the associated pivotal axis and an auger cutter is fixed to the forward end portion of each shaft. In the arrangement disclosed in U.S. Pat. No. 4,341,424, an electric motor and speed reducing unit is mounted on the central frame for rotating each of the auger cutters about their respective axes. The drive is in opposite directions and the augers are oppositely pitched. This arrangement of the driving components with respect to the side frames allowed the auger cutters to be mounted in relatively closely spaced horizontal relation. On the other hand, the arrangement materially increased the longitudinal horizontal dimension of the central frame and materially restricted the vertical movement of the auger cutters which could be undertaken by the hydraulic rams mounted between the central frame and the side frames along the upper portions thereof.

An object of the present invention is to provide for the arrangement of the power operated driving means for the auger cutters in such a way as to enable the longitudinal extent of the central frame to be reduced, and the auger cutters to be mounted for extended vertical movement about their pivotal axes and for otherwise enhancing the bearing and load characteristics of the assembly. In accordance with the principles of the present invention, this objective is obtained by providing an elongated shaft rotatably mounted on each of the side frames so as to extend longitudinally from a position adjacent the rearward portion of the associated side frame forwardly thereof to an extent such that a forward end portion of each shaft extends forwardly of the associated side frame. A speed reducing unit is mounted on each side frame between the associated shaft and the associated pivotal axis in driving relation with respect to the rearward portion of the associated shaft. An electric motor is mounted on each side frame between the associated shaft and the associated pivotal axis forwardly of the associated speed reducing unit in driving relation thereto. By this arrangement, the bearing loads are better distributed, frame deflections are materially reduced with respect to those previously encountered and a saving of two feet in the longitudinally horizontal extent of the central frame is obtained.

The type of machine embodied in U.S. Pat. No. 4,341,424 includes in addition to the cutting assembly a rearward assembly which is mounted on an endless track assembly for effecting the forward movements of the cutter assembly. In addition, the cutter assembly is pivotally mounted with respect to the rearward assembly for movements about a generally vertically extending axis and hydraulic piston and cylinder units are provided between the rearward assembly and the cutter assembly for effecting the movements of the cutter assembly across the face. In accordance with the principles of the present invention, where the motor and speed reducing unit are carried by the side frames, it has been found desirable to detachably connect the piston and cylinder units which affect the swinging movement of the cutter assembly so as to enable the same to be operated in such a way that contracting and extending movements are utilized to effect removal and installation of the motor and speed reducing unit on the corresponding side frame rather than pivotal movements of the cutter assembly.

Accordingly, it is an object of the present invention to provide a continuous mining machine of the type described having the aforesaid capability of dual mode use of the piston and cylinder units as described above.

Another object of the present invention is the provision of a continuous mining machine of the type described which is simple in construction, effective in operation, and economic to manufacture and maintain.

These and other objects of the present invention will become more apparent during the course of the following detailed description and appended claims.

The invention may best be understood in connection with the accompanying drawings wherein an illustrative embodiment is shown.

IN THE DRAWINGS

Figure 1A:
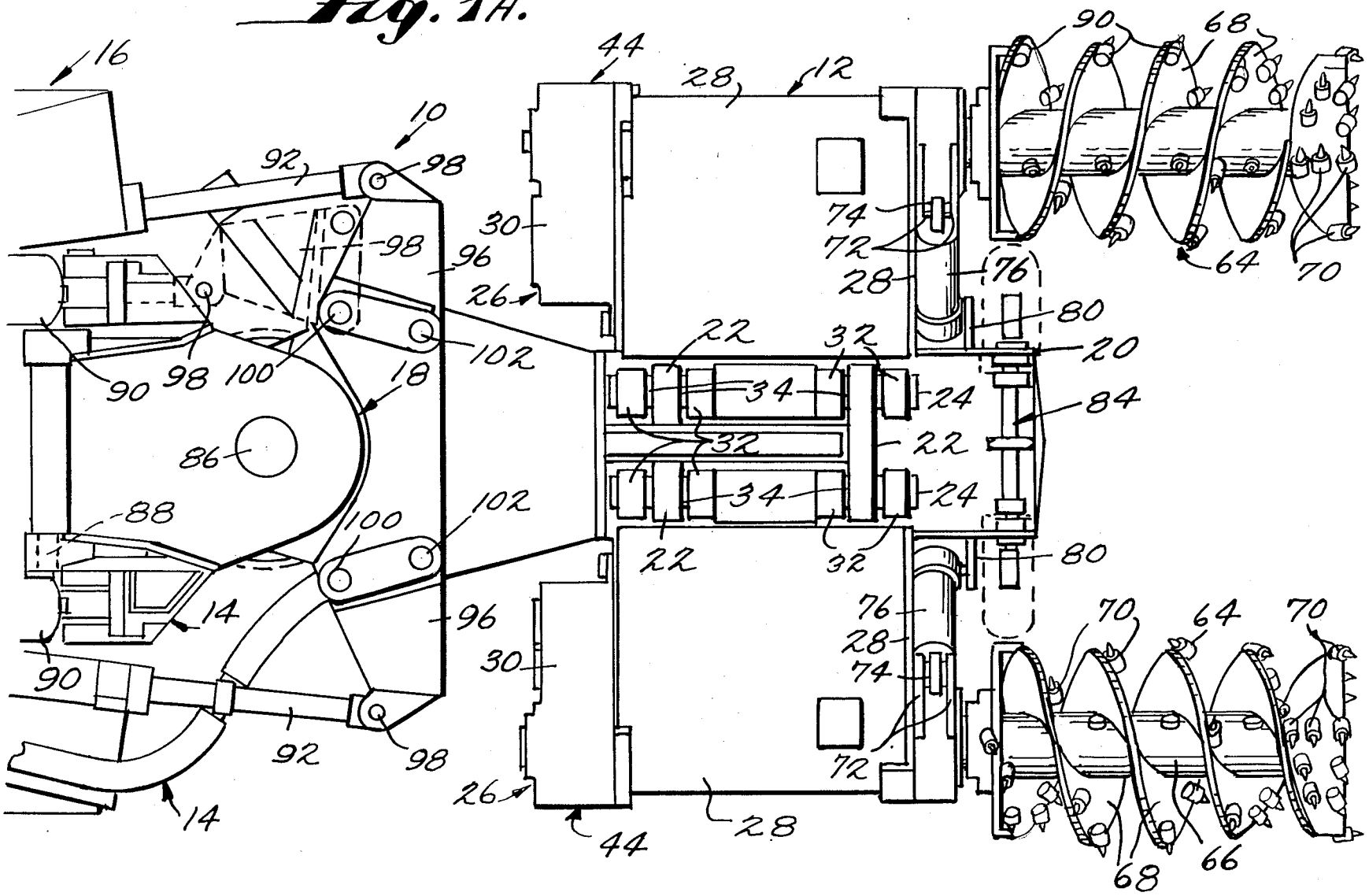
FIG. 1 is a top plan view of a continuous mining machine embodying the principles of the present invention, the top plan view being divided into three sections designated by the subscripts A, B, and C.

Referring now more particularly to the drawings, there is shown therein a continuous mining machine, generally indicated at 10, embodying the principles of the present invention. As shown, the mining machine 10 is formed of essentially three different assemblies which include a forward cutter assembly, generally indicated at 12, a rearward assembly, generally indicated at 14, and a endless track assembly, generally indicated at 16. The rearward assembly 14 is supported on the endless track assembly 16 and the forward cutter assembly 12 is connected for horizontal swinging movement with the rearward assembly 14 by a yoke structure, generally indicated at 18. The forward cutter assembly 12 is thus suitable to be moved forwardly with respect to a mine face by the operation of the endless track assembly 16 and horizontally across the mine face by the swinging movement of the cutter assembly 12 with respect to the rear assembly 14. The endless track assembly 16 also serves to effect a tramming movement of the entire continuous mining machine 10 within the mine from one position of operation to another.

The cutter assembly 12 includes a central frame 20 which is of boxlike configuration preferably formed of metal plates suitably welded together. Fixed to the upper wall of the boxlike frame 20 in a position inwardly of each side wall thereof is a pair of rigid lugs 22. Each pair of lugs is formed with transversely spaced pairs of aligned openings to receive therein a pair of parallel pivot pins 24 which extend longitudinally in a direction corresponding to the forward movement of the cutting assembly with respect to the mine face. Pivotally mounted to each pivot pin 24 is a side frame or swing case, generally indicated at 26. Each side frame 26 is preferably constructed of a series of metal plates 28 suitably welded together and a series of housing parts 30 suitably detachably fixed thereto. Each side frame 26 provides two pairs of lugs 32 which are adapted to be disposed on opposite sides of the associated pair of lugs 22. The pairs of lugs 32 are suitably apertured and provided with bearings 34 for receiving an associated pivot pin 24 so as to mount the associated side frame 26 for pivotal movement about the longitudinal axis of the associated pivot pin 24.

Figure 4:
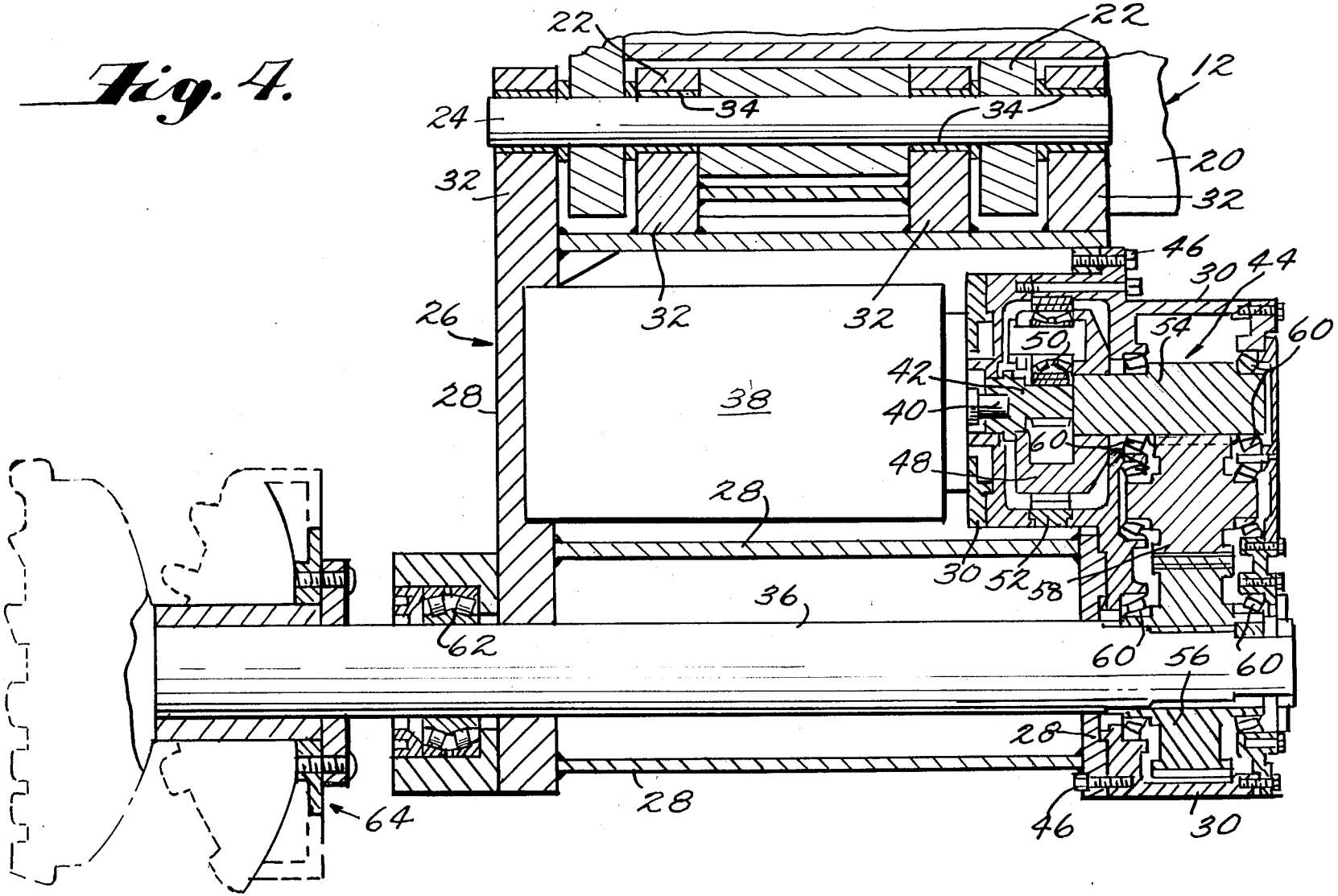
FIG. 4 is an enlarged fragmentary sectional view taken along the lines 4—4 of FIG. 3.

An elongated shaft 36 is rotatably mounted on each of the side frames 26 in generally parallel relation to the associated pivot pin 24 so as to extend longitudinally from a position adjacent the rear portion of the associated side frame 26 forwardly thereof to an extent such that a forward end portion in each shaft 36 extends forwardly of the associated side frame 26. This relationship can be clearly seen in FIG. 4. An electric motor 38 is mounted on each side frame 26 between the associated shaft 36 and the associated pivot pin 24 in a forward position. As best shown in FIG. 4, each electric motor 38 includes a rearwardly extending output shaft 40 which is drivingly connected to an input gear 42 of a speed reducing unit, generally indicated at 44. As shown, each speed reducing unit 44 is mounted within a housing part 30 which is detachably fixed to the welded plates 28 of the associated side frame 26, as by bolts 46 so as to form a fixed part of the associated side frame 26.

Each speed reducing unit 44, as shown, is preferably of the planetary gear type which includes a gear carrier 48, a plurality of planetary gears 50 and a ring gear 52. The carrier is, in turn, connected with an output gear 54 which is drivingly connected to the rear end portion of the associated shaft 36 by a gear 56 fixed to the rearward end of the shaft 36 and an idler gear 58 which meshes with the output gear 54 and the gear 56. Gears 54, 56 and 58 and suitably journaled in bearings 60 carried by detachable housing parts 30. The bearings 60 mounting the gear 56 also serve to rotatably mount the rearward end of the associated shaft 36, the forward end of which is journaled by bearing 62.

Fixed to the projecting forward end portion of each shaft 36 is an auger cutter 64. As best shown in FIG. 1A, the auger cutters 64 are of similar construction except that they are oppositely pitched and oppositely rotated. As shown, each auger cutter 64 includes a central rigid core member 66 having a pair of helical blades 68 fixed to the exterior periphery thereof. Mounted on the tips of the helical blades 68 are a plurality of spaced cutting teeth 70 and suitable cutting teeth 70 are also mounted at the forward ends of the blades 68 so that each auger cutter 64 is capable of both a forward movement inwardly of the seam with respect to the face and a lateral movement across the face in cutting relation to the material forming the seam.

Figure 3:
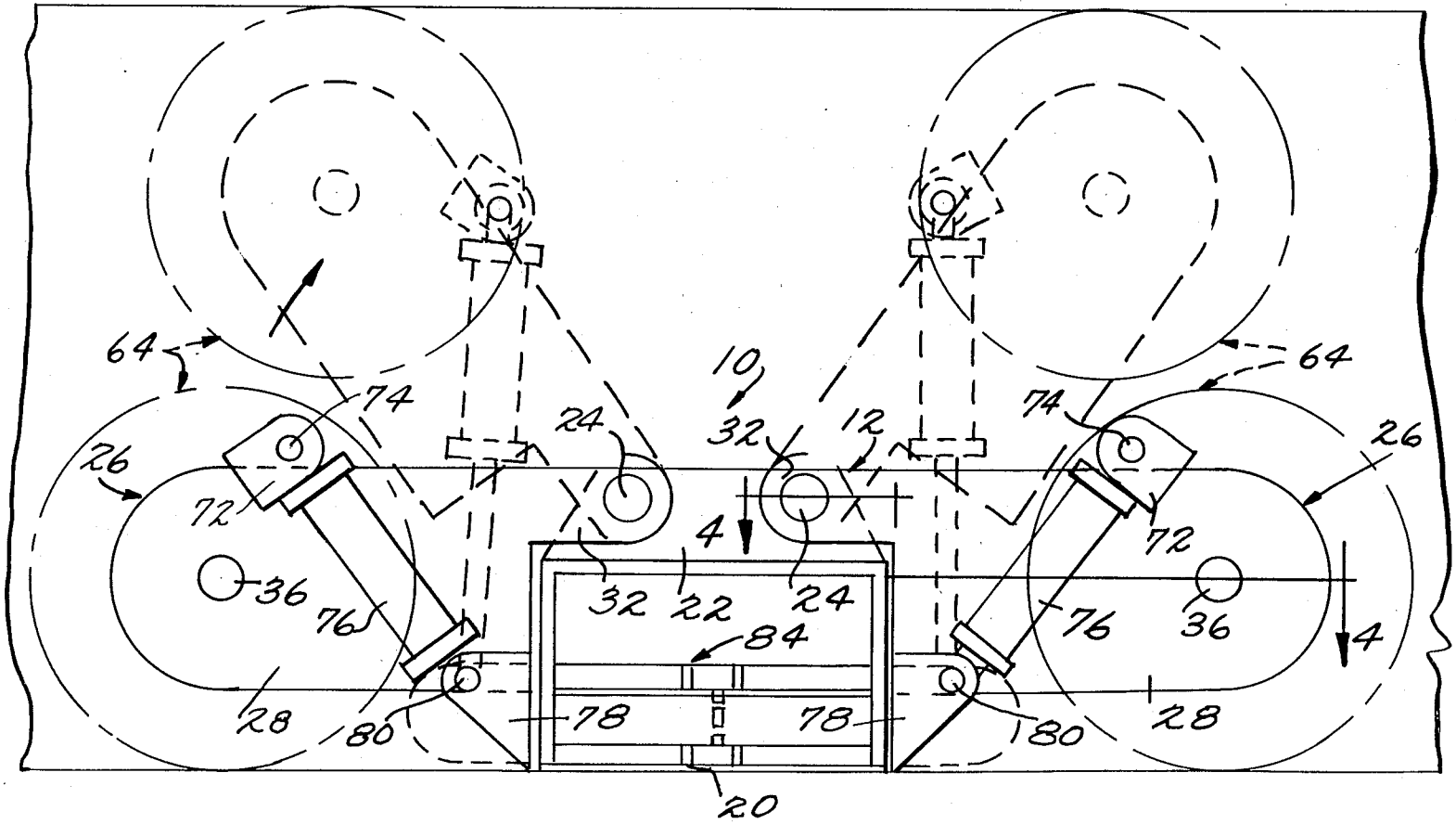
FIG. 3 is a front elevational view with the auger cutters broken away and shown in dotted lines in their lowered positions and in phantom lines in their raised positions.

Referring now more particularly to FIG. 3, each side frame has fixed thereto adjacent the forward upper end thereof a pair of spaced mounting lugs 72 which are suitably apertured to receive a pivot pin 74. Each pivot pin 74 serves to pivotally connect one end of a piston and cylinder unit or hydraulic ram unit 76 to the associated lug 74 and side frame 26. The opposite end of each hydraulic ram unit 76 is pivotally connected to a pivot pin 78 carried by a pair of lugs 80 fixed to the lower forward portion of the associated side wall of the boxlike central frame 20. It can be seen that by extending and contracting each of the hydraulic ram units 76, the associated auger cutter can be moved vertically generally between the positions shown in FIG. 3.

The central frame 20 of the forward assembly 12 is connected by the yoke structure 18 to a central frame 82 of the rearward assembly 14 and a conveying means in the form of an endless scraper conveyor 84 is mounted in conjunction with both central frames 20 and 82 and the yoke structure 18 to enable the mine material loosened from the solid by the auger cutters 64 to be conveyed rearwardly away from the face of the mine seam being mined. As previously indicated, the yoke struture 18 provides for a relative pivotal movement between the forward assembly 12 and the rearward assembly 14 and this is accomplished by aligned pivot pins 86, best shown in FIG. 1A, connected between the forward end of the yoke structure 18 and the rearward end of the forward central frame 20. It will be noted that the yoke structure 18 also provides for a limited pivotal movement about a horizontal pivotal axis, indicated at 88 in FIG. 1A, between the yoke structure 18 and the central frame 82 of the rearward assembly 14. This limited pivotal movement is accomplished by a pair of piston and cylinder units or hydraulic ram units 90 connected between the rearward central frame 82 and the rearward portion of the yoke structure 18.

Figure 1B:
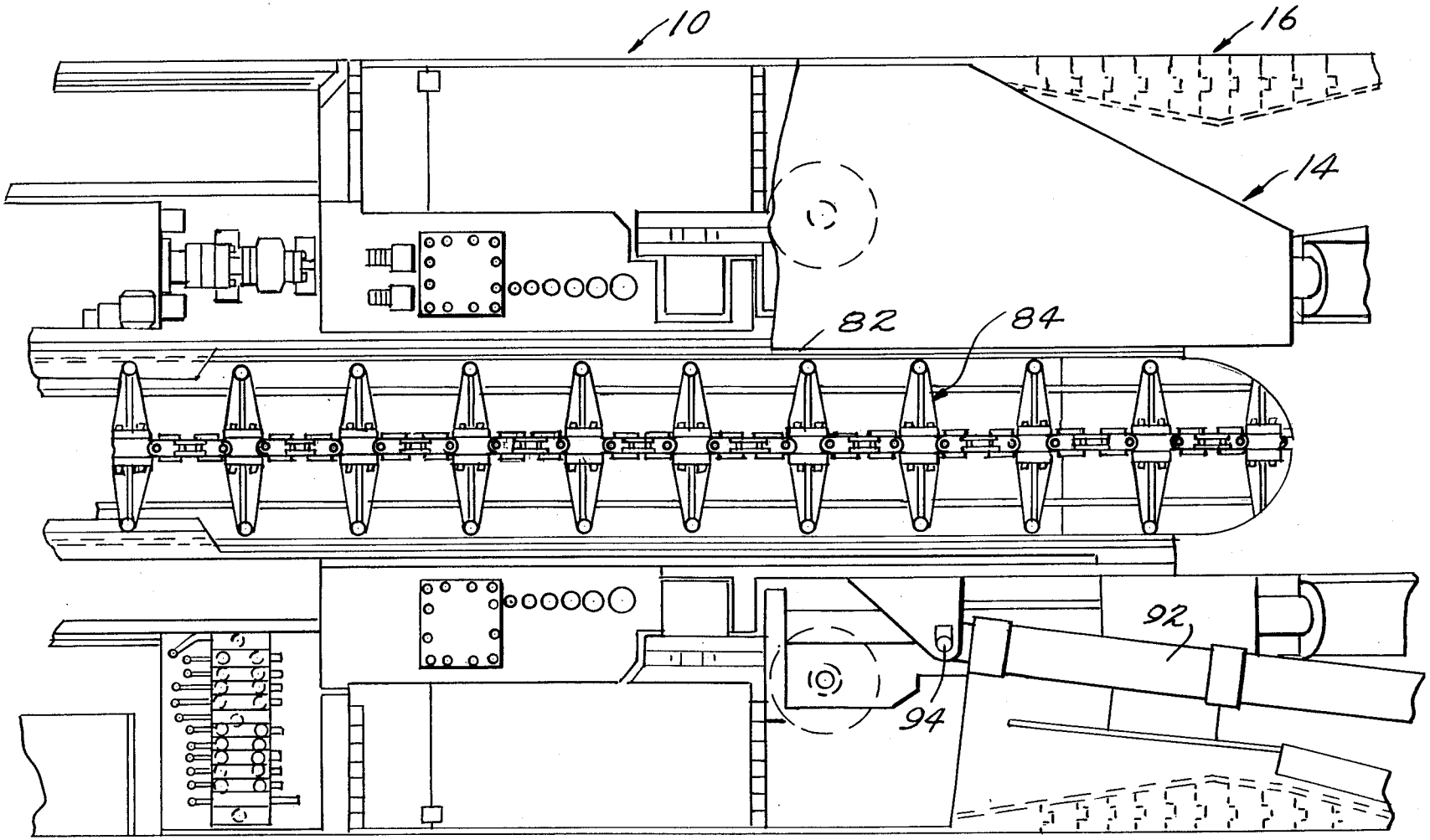
Figure 1C:
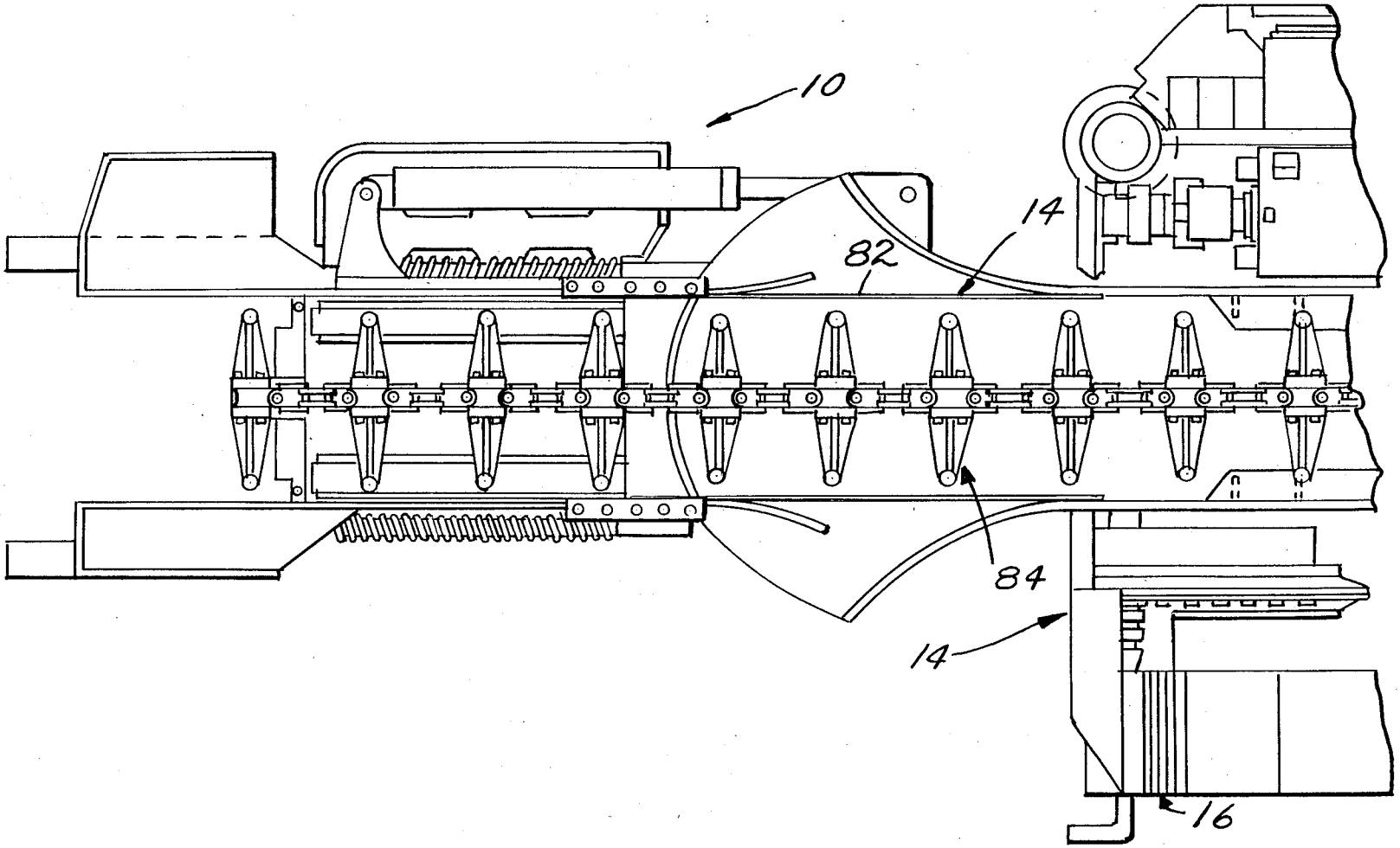
Figure 2A:
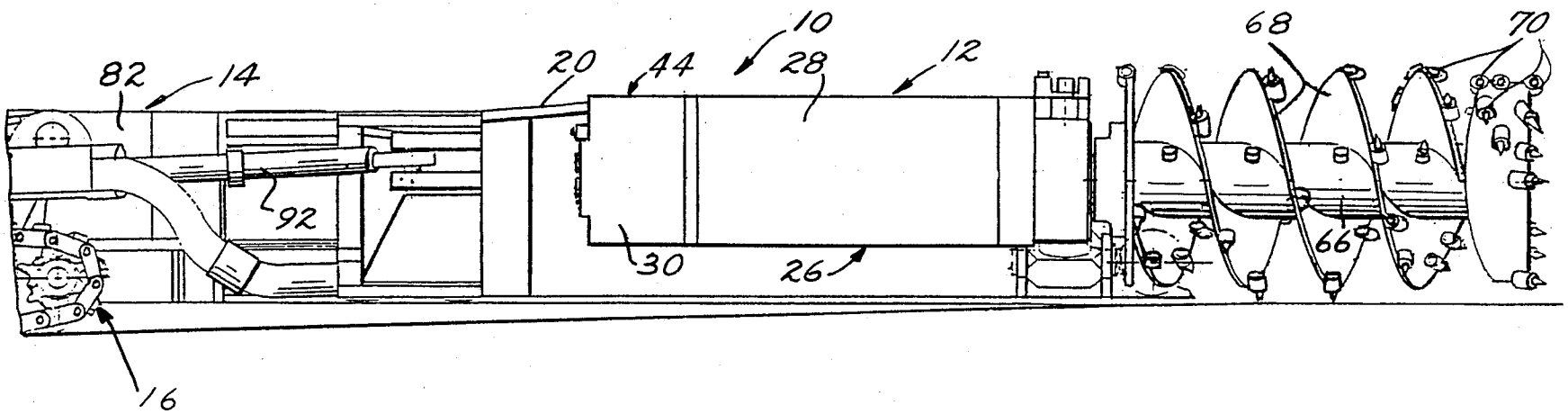
FIG. 2 is a side elevational view of the continuous mining machine, the view being broken up into three sections designated by the subscripts A, B, and C.
Figure 2B:
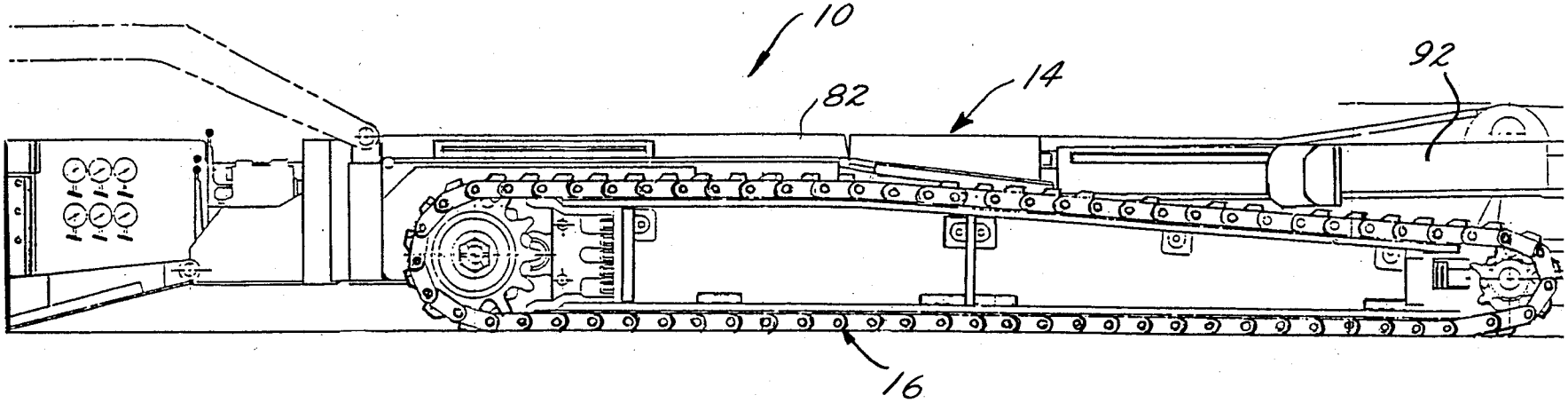
Figure 2C:
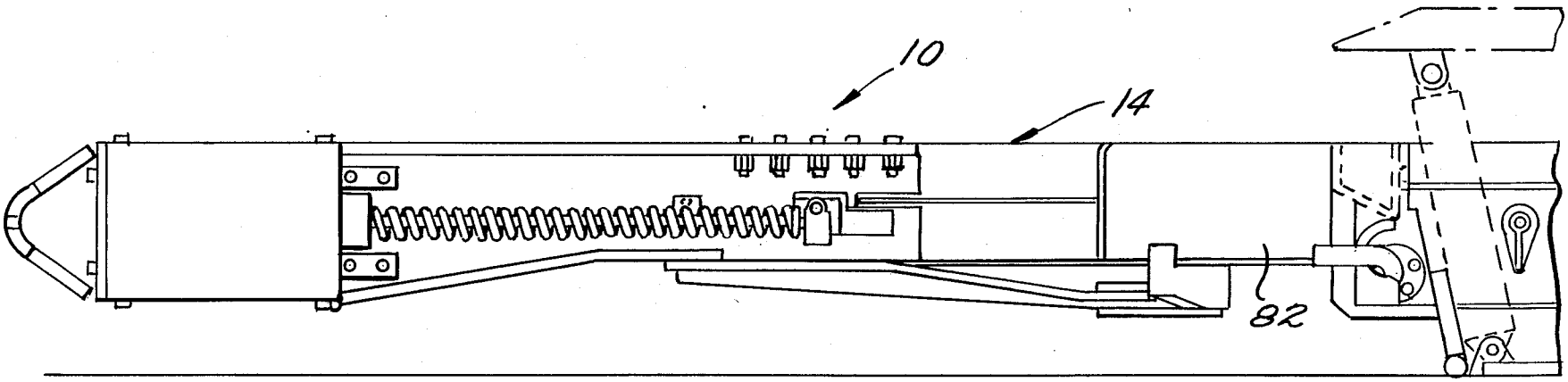

The horizontal swinging movements of the forward central frame 20 with respect to the yoke structure 18 is accomplished by a pair of generally longitudinally extending piston and cylinder units or hydraulic ram units 92 disposed on opposite sides of the yoke structure 18. The rearward end of each hydraulic ram unit 92 is pivoted to the associated rearward central frame 82 as indicated at 94 in FIG. 1B, and the forward end extends forwardly beyond the yoke structure 18 and is connected to a bracket 96, as by pivot pin 98. As best shown in FIG. 1A, each bracket 96 is pivotally connected to the rear end of the associated side of the forward central frame 20, as by a fixed pivot pin 100. A detachable pin 102 serves to connect the forward portion of each bracket 96 with the associated side of the rearward portion of the forward central frame 20. As best shown in FIG. 1A, the arrangement is such that the operation of each hydraulic ram unit with the detachable pivot pins 102 in operative position serve to effect the horizontal swinging movements of the forward cutter assembly 12 as desired. Alternatively, by removing the detachable pins 102, the brackets 96 become power operated members which are movable through controlled arcuate movements by contraction and extension of the associated hydraulic ram so as to assist in the removal and installation of the associated motors 38, the associated reducing units 44 and the associated housing parts 30 after removing the bolts 46. In this way, service of the components carried by the side frames 26 is greatly facilitated. Chains or similar instrumentalities, not shown, may be used in conjunction with the brackets 96 to act as connectors between the brackets and the instrumentalities being removed or installed.

It will be understood that the construction of the conveying means 84, the construction of the rearward assembly 14, and the construction of the endless track assembly 16 are all constructed with the teachings contained in the aforesaid U.S. Pat. No. 4,341,424. Accordingly, for any details of construction, reference may be made to the disclosure of this patent.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A continuous mining machine comprising a cutter assembly suitable to be moved forwardly with respect to a mine face and transversely across the mine face, said cutter assembly including a central frame, a pair of side frames mounted on said central frame for independent pivotal movement about a pair of axes generally parallel with each other extending in a longitudinal direction corresponding generally to the forward direction of movement of the forward assembly with respect to the mine face, an elongated shaft rotatably mounted on each of said side frames in generally parallel relation to the associated pivotal axis so as to extend longitudinally from a position adjacent the rearward portion of the associated side frame forwardly thereof to an extent such that a forward end portion of each shaft extends forwardly of the associated side frame, a speed reducing unit mounted on each side frame between the associated shaft and the associated pivotal axis and drivingly connected with a rearward portion of the associated shaft, an electric motor mounted on each side frame between the associated shaft and the associated pivotal axis forwardly of the associated speed reducing unit in driving relation thereto, an auger cutter fixed to the forward end portion of each shaft, power operated means between said central frame and each side frame for independently effecting movement of each side frame about its pivotal axis so as to swing the associated auger cutter about the associated pivotal axis in cutting relation to the mine material inwardly of the face so as to remove successive room sections therefrom in conjunction with the movements of the cutter assembly forwardly and across the mine face, and means on said central frame for conveying the material cut from the mine face by said auger cutters rearwardly away from the mine face.

2. A continuous mining machine as defined in claim 1 wherein said cutter assembly is connected with a rearward assembly, said central frame including a forward section forming a part of said cutter assembly and a rearward section forming a part of said rearward assembly pivotally connected at a forward end thereof to a rearward end of said forward frame section about a generally vertically extending axis, said conveying means extending longitudinally substantially throughout the cutter and rearward assemblies so that a forward section thereof forms a part of said cutter assembly and a rearward section thereof forms a part of said rearward assembly, power operated means for effecting pivotal movements of said forward frame section about said vertical axis with respect to said rearward frame section so as to effect the movements of said cutter assembly across the mine face, and power operated endless track means operatively connected with said rearward frame section for effecting the forward movements of said cutter assembly with respect to the mine face as well as tramming movements into different locations within the mine.

3. A continuous mining machine as defined in claim 2 wherein said forward frame section moving means comprises a pair of hydraulic piston and cylinder units pivotally mounted at rearward ends thereof to opposite sides of said rearward frame section and at forward ends thereof to opposite sides of said forward frame section.

4. A continuous mining machine as defined in claim 3 wherein each of said hydraulic piston and cylinder units has its forward end connected to the forward frame section by detachable means for enabling the associated piston and cylinder unit to be operated in such a way that contracting and extending movements are utilized to effect removal and installation of the motor and speed reducing unit on the corresponding side frame rather than pivotal movements of said cutter assembly.

5. A continuous mining machine as defined in claim 4 wherein the detachable means associated with each piston and cylinder unit comprises a mounting bracket having a fixed pivotal connection with the associated side of said forward frame section, a fixed pivotal connection with the forward end of the associated piston and cylinder unit and a detachable connection with the associated side of said forward frame section in forwardly spaced relation with the fixed pivotal connection therewith.

6. A continuous mining machine as defined in claim 5 wherein said central frame comprises a boxlike structure between said side frames, said pivotal axes being disposed along an upper wall of the boxlike structure inwardly of side walls thereof.

7. A continuous mining machine as defined in claim 6 wherein each side frame moving means comprises a hydraulic ram unit, each hydraulic ram unit being pivotally mounted at one end on lower lugs fixed to a forward lower portion of the associated side wall and at an opposite end to upper lugs fixed to a forward upper portion of the associated side frame.

8. A continuous mining machine as defined in claim 1 wherein said central frame comprises a boxlike structure between said side frames, said pivotal axes being disposed along an upper wall of the boxlike structure inwardly of side walls thereof.

9. A continuous mining machine as defined in claim 8 wherein each side frame moving means comprises a hydraulic ram unit, each hydraulic ram unit being pivotally mounted at one end on lower lugs fixed to a forward lower portion of the associated side wall and at an opposite end to upper lugs fixed to a forward upper portion of the associated side frame.

10. A continuous mining machine comprising a cutter assembly suitable to be moved forwardly with respect to a mine face and transversely across the mine face, said cutter assembly including a central frame, a pair of side frames mounted on said central frame for independent pivotal movement about a pair of axes generally parallel with each other extending in a longitudinal direction corresponding generally to the forward direction of movement of the forward assembly with respect to the mine face, an elongated shaft rotatably mounted on each of said side frames in generally parallel relation to the associated pivotal axis, a speed reducing unit mounted on each side frame and drivingly connected with the associated shaft, an electric motor mounted on each side in driving relation to the associated speed frame reducing unit, an auger cutter fixed to the forward end portion of each shaft, power operated means between said central frame and each side frame for independently effecting movement of each side frame about its pivotal axis so as to swing the associated auger cutter about the associated pivotal axis in cutting relation to the mine material inwardly of the face so as to remove successive room sections therefrom in conjunction with the movements of the cutter assembly forwardly and across the mine face, a rearward assembly connected with said cutter assembly, said central frame including a forward section forming a part of said cutter assembly and a rearward section forming a part of said rearward assembly pivotally connected at a forward end thereof to a rearward end of said forward frame section about a generally vertically extending axis, conveying means on said central frame for conveying the material cut from the mine face by said auger cutters rearwardly away from the mine face, said conveying means extending longitudinally substantially throughout the cutter and rearward assemblies so that a forward section thereof forms a part of said cutter assembly and a rearward section thereof forms a part of said rearward assembly, power operated means for effecting pivotal movements of said forward frame section about said vertical axis with respect to said rearward frame section so as to effect the movements of said cutter assembly across the mine face, and power operated endless track means operatively connected with said rearward frame section for effecting the forward movements of said cutter assembly with respect to the mine face as well as tramming movements into different locations within the mine, said forward frame section moving means comprising a pair of hydraulic piston and cylinder units pivotally mounted at rearward ends thereof to opposite sides of said rearward frame section and at forward ends thereof to opposite sides of said forward frame section, each of said hydraulic piston and cylinder units has its forward end connected to the forward frame section by detachable means for enabling the associated piston and cylinder unit to be operated in such a way that contracting and extending movements are utilized to effect removal and installation of the motor and speed reducing unit on the corresponding side frame rather than pivotal movements of said cutter assembly.

11. A continuous mining machine as defined in claim 10 wherein the detachable means associated with each piston and cylinder unit comprises a mounting bracket having a fixed pivotal connection with the associated side of said forward frame section, a fixed pivotal connection with the forward end of the associated piston and cylinder unit and a detachable connection with the associated side of said forward frame section in forwardly spaced relation with the fixed pivotal connection therewith.

12. A continuous mining machine as defined in claim 11 wherein said central frame comprises a boxlike structure between said side frames, said pivotal axes being disposed along an upper wall of the boxlike structure inwardly of side walls thereof.

13. A continuous mining machine as defined in claim 12 wherein each side frame moving means comprises a hydraulic ram unit, each hydraulic ram unit being pivotally mounted at one end on lower lugs fixed to a forward lower portion of the associated side wall and at an opposite end to upper lugs fixed to a forward upper portion of the associated side frame.

14. A continuous mining machine as defined in claim 10 wherein said central frame comprises a boxlike structure between said side frames, said pivotal axes being disposed along an upper wall of the boxlike structure inwardly of side walls thereof.

15. A continuous mining machine as defined in claim 14 wherein each side frame moving means comprises a hydraulic ram unit, each hydraulic ram unit being pivotally mounted at one end on lower lugs fixed to a forward lower portion of the associated side wall and at an opposite end to upper lugs fixed to a forward upper portion of the associated side frame.

* * * * *